United States Patent [19]

Yokoyama et al.

[11] Patent Number: 4,733,488

[45] Date of Patent: Mar. 29, 1988

[54] DECORATIVE DISPLAY APPARATUS

[75] Inventors: Meiso Yokoyama; Makoto Takahashi; Hiroshi Ohkawa, all of Nagaoka, Japan

[73] Assignee: Nippon Seiki Co., Ltd., Nigata, Japan

[21] Appl. No.: 701,216

[22] Filed: Feb. 13, 1985

[51] Int. Cl.[4] ..... G09F 13/22

[52] U.S. Cl. ..... 40/544; 40/542; 313/498; 313/512

[58] Field of Search ..... 40/544, 542; 313/498, 313/512, 510, 51

[56] References Cited

U.S. PATENT DOCUMENTS

| | | | |
|---|---|---|---|
| 899,321 | 9/1908 | Reix | 40/451 |
| 2,002,775 | 5/1935 | Henninger | 313/512 |
| 2,733,367 | 1/1956 | Gillson | 40/544 |
| 3,037,137 | 5/1962 | Motson | 313/511 |
| 3,052,811 | 9/1962 | Katona | 313/511 |
| 3,161,974 | 12/1964 | Blockson | 40/544 |
| 3,317,722 | 5/1967 | Whitney | 313/512 |
| 3,430,088 | 2/1969 | Beswick . | |
| 3,509,401 | 4/1970 | Calley et al. | 313/512 |
| 3,986,068 | 10/1976 | Albrecht . | |
| 4,005,924 | 2/1977 | Nestor . | |
| 4,286,195 | 8/1981 | Swinea, Jr. . | |
| 4,306,178 | 12/1981 | Nixon . | |
| 4,356,428 | 10/1982 | Hanlet . | |
| 4,358,708 | 11/1982 | Silva et al. . | |
| 4,378,649 | 4/1983 | Cokefair | 40/544 |
| 4,414,452 | 11/1983 | Denley . | |
| 4,419,722 | 12/1983 | Bury . | |
| 4,458,177 | 7/1984 | Hunter et al. | 313/498 |

FOREIGN PATENT DOCUMENTS

| | | | |
|---|---|---|---|
| 294596 | 6/1968 | Australia | 40/542 |
| 1909814 | 2/1969 | Fed. Rep. of Germany | 313/498 |
| 1,204,806 | 1/1960 | France . | |
| 1,422,265 | 11/1965 | France . | |
| 1,603,022 | 4/1971 | France . | |
| 911,603 | 11/1982 | United Kingdom . | |

OTHER PUBLICATIONS

Takagi, Katsuki and Yamada, Shoji, "Opto Solid State of Semiconductor", *Electronic Science Series,* Revised Edition, 1974, Part 4–2, p. 5.

*Primary Examiner*—Robert P. Swiatek
*Assistant Examiner*—Wenceslao J. Contreras
*Attorney, Agent, or Firm*—Lowe, Price, Leblanc, Becker & Shur

[57] ABSTRACT

A luminous decorative display apparatus to be employed in setting off the design of a Christmas tree or commodities. The apparatus is provided with a plurality of two-sided flat luminous display elements each having an electroluminescent layer formed contiguously between opposite transparent electrodes and capable of shining in a specific color and a specific shape when a voltage is applied to the transparent electrodes. Each display element is connected through the electrode terminals extending from the transparent electrodes respectively, in parallel connection to power supply lines. The display elements are distributed on an article to be decorated and made to shine for decorating the article.

8 Claims, 7 Drawing Figures

DECORATIVE DISPLAY APPARATUS

BACKGROUND OF THE INVENTION

1. Field of the Invention

The present invention relates to a decorative display apparatus employing two-sided flat luminous bodies, and methods for manufacturing such apparatus.

2. Description of the Prior Art

Usually, a luminous decorative display apparatus employing lamps, fluorescent display tubes or neon tubes is provided around a Christmas tree or in a show window for exhibiting commodities to set off the designs of the articles on exhibition, such as a Christmas tree or commodities. In such a conventional decorative display apparatus employing lamps, the lamps are covered with covers of various colors and shapes made of a colored transparent resin according to the user's preference with regard to the color of light and shape. In this conventional decorative display apparatus, the covers may possibly be deformed or ignited by the heat generated by the lamps when the lamps are kept lighted up for an extended period of time.

Prior art of this type is disclosed in the specifications of U.S. Pat. Nos. 3,986,068 and 4,005,924 respectively.

In a display apparatus employing fluorescent display tubes or neon tubes, the color of light can vary according to the type of gas sealed in the tube, and the morphology of the tubes is not limited only to a linear form but can include a curved form. However, a high voltage as high as tens of thousands volt needs to be applied to light up such lamps, which may be disadvantage.

Prior art of this type is disclosed in the respective specifications of U.S. Pat. Nos. 4,286,195, 4,306,178 and 4,356,428.

Recently, a decorative display apparatus employing light emission diodes, which can be lighted up by applying a low voltage and can readily be made in the required form and color, has become available. However, it is impossible to make a light emission diode having a large luminous area, and hence the light emission diode can form only a light spot which is rather limiting.

Prior art of this type is disclosed in the respective specifications of U.S. Pat. Nos. 4,358,708, 4,414,452 and 4,419,722.

SUMMARY OF THE INVENTION

Accordingly, it is an object of the present invention to provide a display apparatus having at least one two-sided flat luminous display element utilizing an electroluminescence effect (designated as "EL effect" hereinafter), connectable in parallel to a power supply allowing suitable selection of color of light and shape according to the article to be decorated, capable of being formed in a two-sided luminous body of a large area, free from dangerous level of heat generation, and capable of being lighted up by applying a relatively low voltage thereto. It is another object of this invention to provide methods for manufacturing flat two-sided electroluminous display apparatus.

These and other objects, features and advantages of the present invention will become more apparent from the following description when taken in conjunction with the accompanying drawings, in which preferred embodiments of the present invention are shown by way of illustrative example. Like characters designate like parts throughout.

DETAILED DESCRIPTION OF THE PREFERRED EMBODIMENTS

Figure 1:
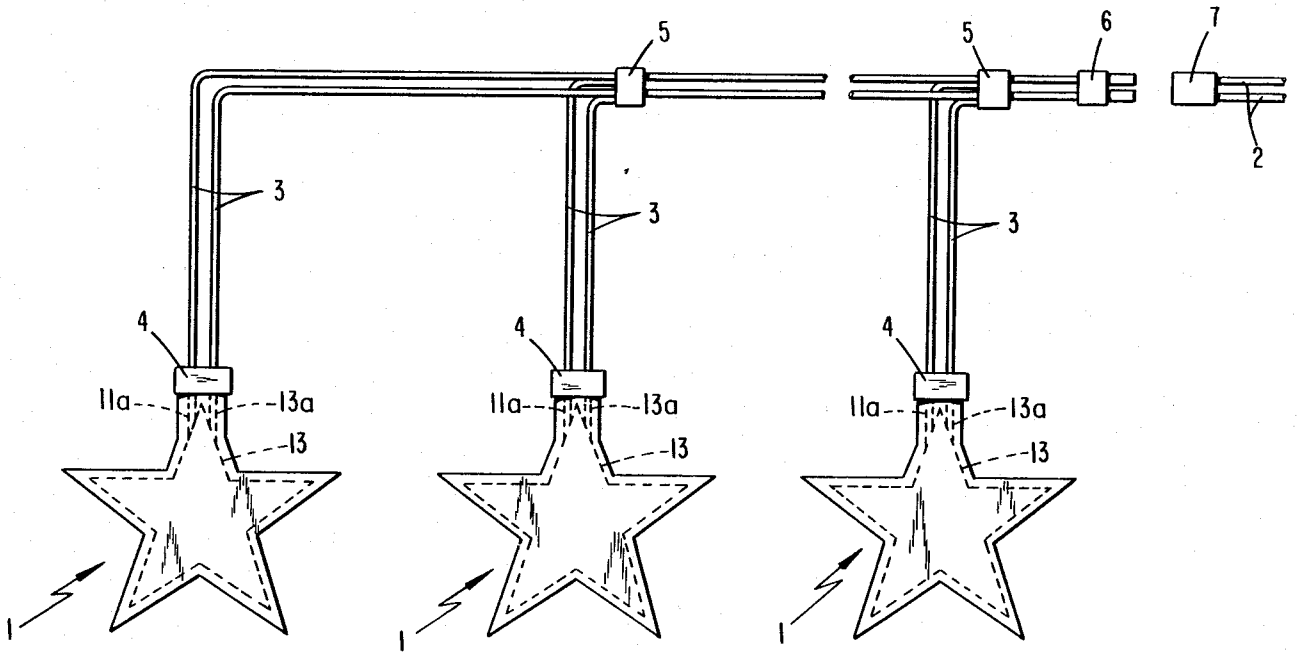
FIG. 1 is a plan view showing the constitution of a first embodiment of the present invention.
Figure 2:
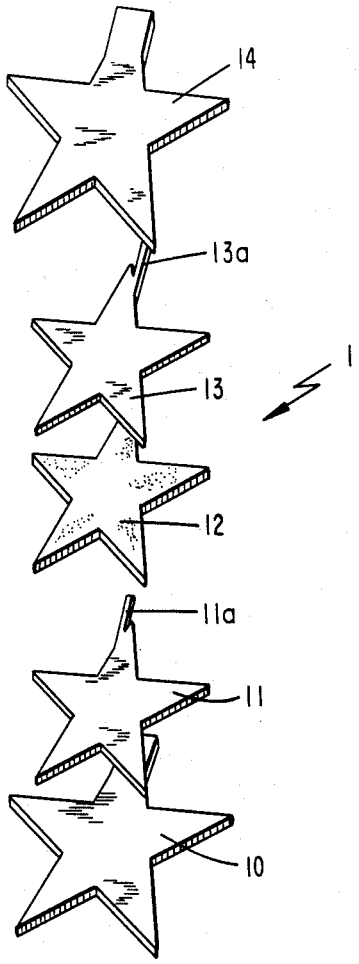
FIGS. 2 and 3 are an exploded perspective view, and a sectional view respectively, showing the constitution of a display element employed in the embodiment shown in FIG. 1.

FIG. 1 is an illustration showing the constitution of a decorative display apparatus, according to the present invention, for decorating a Christmas tree. In FIG. 1, there are shown two-sided flat luminous display elements 1, which will be described later, power supply lines 2 connected to a power source circuit, not shown, for driving the display elements 1 for light emission, and connection cords 3 for electrically connecting the display elements 1 to the power supply lines 2. Each connection cord 3, as best seen in FIG. 2, consists of a conductor 31, such as a copper wire, and an insulating covering 32, such as a vinyl covering. A plurality of the display elements 1 are connectable in parallel connection to the power supply lines 2 through the connection cords 3. One end each connection cord 3 is connected through a connecting member 4 made of a resin such as vinyl to the electrode terminal, of the display element 1, and the other end of cord 3 is connected through a joint 5 and a connector 6 to a connector 7 of the power supply lines 2.

Figure 3:
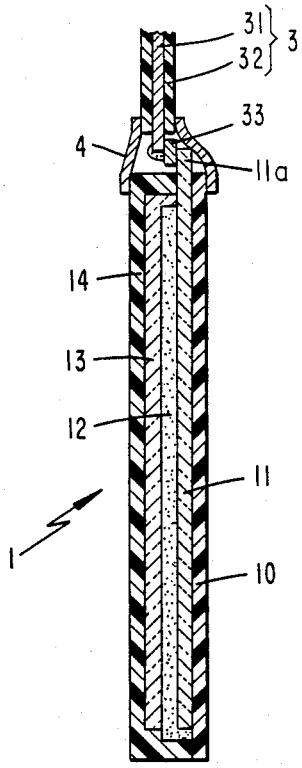

FIGS. 2 and 3 are explanatory views showing the constitution of the display element 1. In FIGS. 2 and 3, there are shown a substrate 10 formed of a transparent resin film consisting of superposed layers of an ethylene chloride trifluoride film and a polyethylene film, or the like, a first transparent electrode 11 formed by depositing a film of a transparent conductive substance, such as an ITO film, over the surface of a transparent resin film, such as a polyester film, shaped in the desired luminous shape such as a star-shape and disposed on the substrate 10 so that part thereof forms an electrode terminal 11*a*, and an EL layer 12 formed over the surface of the transparent electrode 11 in a shape corresponding to the luminous shape by applying a substance corresponding to the color of light to be emitted, such as ZnS doped with Cu which serves as the activation center, and Cl which serves as a flux to the first transparent electrode 111. Also shown in context are a second transparent electrode 13 of a constitution similar to that of the first transparent electrode 11, having a shape corresponding to the luminous shape and superposed over the EL layer 12 so that part thereof forms an electrode terminal 13*a* offset to be out of alignment with the electrode terminal 11*a* of the first transparent electrode 11 on the substrate 10, and a protective member 14 of a constitution similar to that of the substrate 10, for sealing, therewith the first transparent electrode 11, the second transparent electrode 13 and the EL layer 12.

A method for manufacturing the display element 1 will be described hereinafter.

First, the first transparent electrode 11 is produced by depositing a film of a transparent conductive substance, such as an ITO film, over the surface of a transparent resin film, such as a flat polyester film, in the luminous shape through evaporation or sputtering, and then the part of the transparent resin film carrying the film of a transparent conductive substance is cut out in the luminous shape, together with the electrode terminal 11*a*, from the transparent resin film.

Secondly, the first transparent electrode 11 is placed on one an adhesive coated side coated with an adhesive of the substrate 10 having an area slightly greater than that of the transparent electrode 11.

Thirdly, the EL layer 12 of a shape corresponding to the luminous shape (ordinarily, a shape practically the same as that of the first transparent electrode 11) is formed over the surface of the first transparent electrode 11 through screen printing or the like.

Fourthly, the second transparent electrode 13 having a constitution similar to that of the first transparent electrode 11 and the same or practically the same shape as that of the first transparent electrode 11 is placed over the EL layer 12 on the substrate 10 so that the electrode terminal 13*a* thereof is offset out of alignment with the electrode terminal 11*a* of the first transparent electrode 11.

Fifthly, the protective member 14 having a constitution similar to that of the substrate 10 and coated over one side thereof with an adhesive is placed over the second transparent electrode 13, with the side coated with the adhesive in contact with the second transparent electrode 13, leaving the respective portions of the electrode terminal 11*a* and 13*a* of the first transparent electrode 11 and the second transparent electrode 13 exposed.

Sixthly, the display element 1 is subjected to a laminating process at a suitable temperature and under a suitable pressure to seal the first transparent electrode 11, the second transparent electrode 13 and the EL layer 12 between the substrate 10 and the protective member 14.

The display element 1 thus produced is connected to the power supply lines 2 by means of the connecting cords 3 fixed to the electrode terminals 11*a* and 13*a*. The connecting cords 3 are connected satisfactorily by adhesively attaching a piece of copper foil 33 soldered previously to the conductor 31 of the connecting cord 3 with an adhesive, then welding one end of the connecting member 4 welded at the other end to the insulating covering 32 of the connecting cord 3 to the display element 1, and then fixing the connecting member 4 to the display element 1 with a resin adhesive, such as an epoxy resin adhesive.

When the power supply lines 2 apply a suitable AC voltage of symmetrical polarity, ordinarily, an AC voltage of 200 V effective voltage and 50 Hz frequency, to the first and second transparent electrodes 11 and 13 through the connecting cords 3, a potential difference corresponding to the voltage is induced between the first and second transparent electrodes 11 and 13 disposed on opposite sides of the EL layer 12. Consequently, electrons sufficiently energized in the conductive substance by the exciting and accelerating effects of an electric field produced in the EL layer 12 excite the active substance, namely, the copper luminous centers, and when the excited copper luminous centers return to the base state, green light of a wide wavelength range with a peak wavelength of approximately 5120 Å is emitted.

Figure 4:
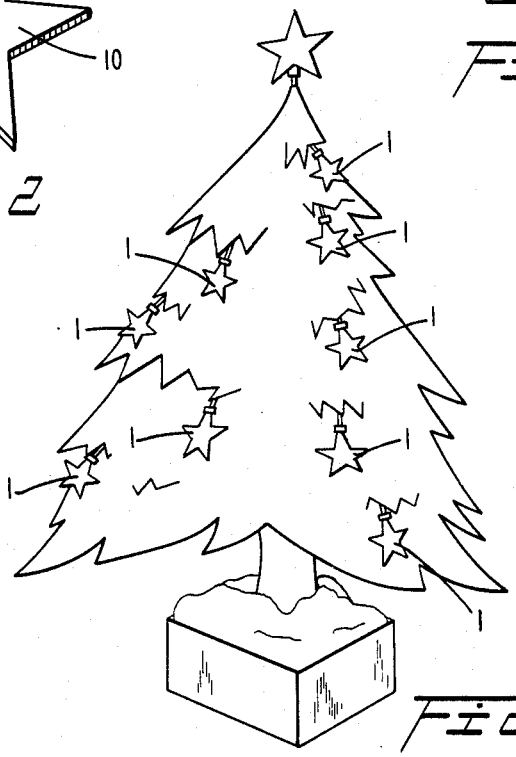
FIG. 4 is a perspective view of the embodiment of FIG. 1 as applied for decorating a Christmas tree.

In this display apparatus, the color of the light emitted by the display element is dependent on the substance forming the EL layer 12, and the luminous shape can optionally be decided by the respective shapes of the first and second transparent electrodes 11 and 13, and/or the EL layer 12, therefore, two-sided luminous body of a wide area can be formed. Furthermore, since the display apparatus generates very little heat and is capable of being operated by a comparatively low voltage, the display apparatus provides a satisfactory decorative display for use on a Christmas tree (FIG. 4).

Figure 5:
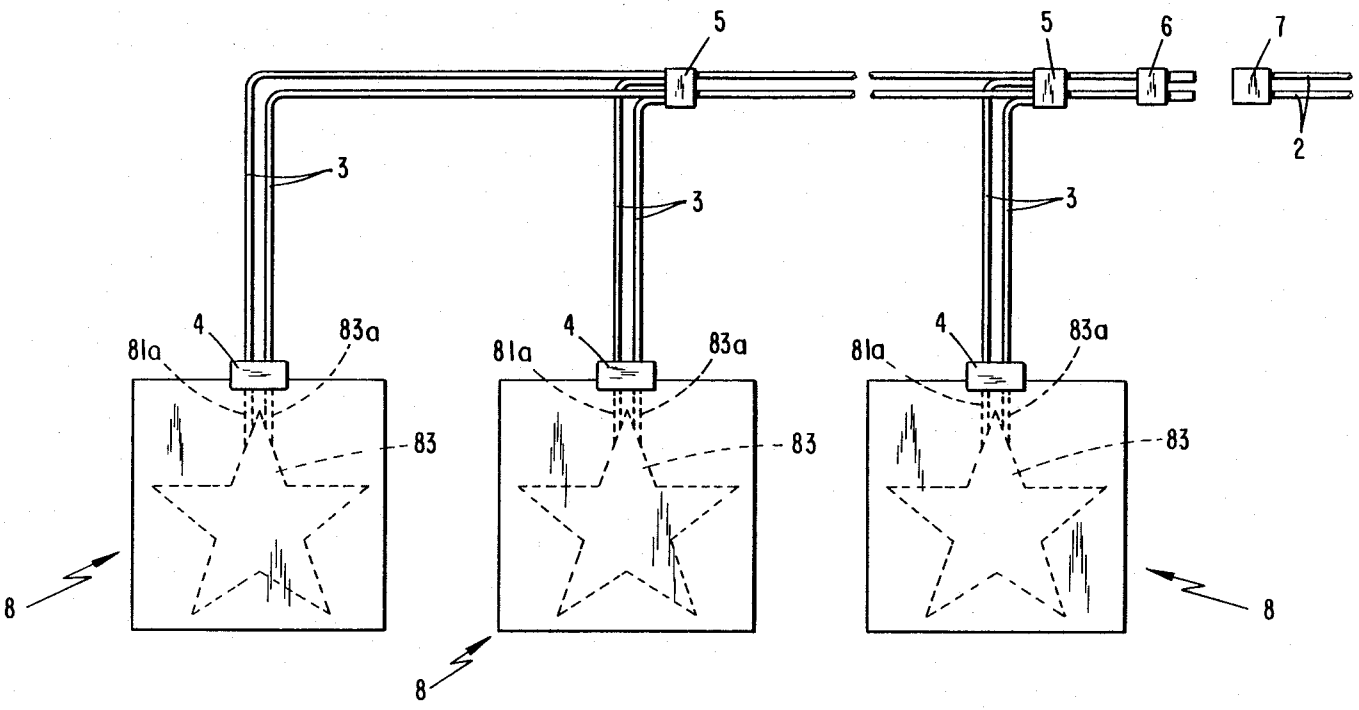
FIG. 5 is a plan view showing the constitution of a second embodiment of the present invention.

FIG. 5 is an explanatory view showing the constitution of a decorative display apparatus according to the present invention, for a Christmas tree, in which the respective constitutions of power supply lines 2, connecting cords 3, a connecting member 4, a joint 5, and connectors 6 and 7, except display elements 8, and connection between the corresponding parts are the same as those of the first embodiment.

Figure 6:
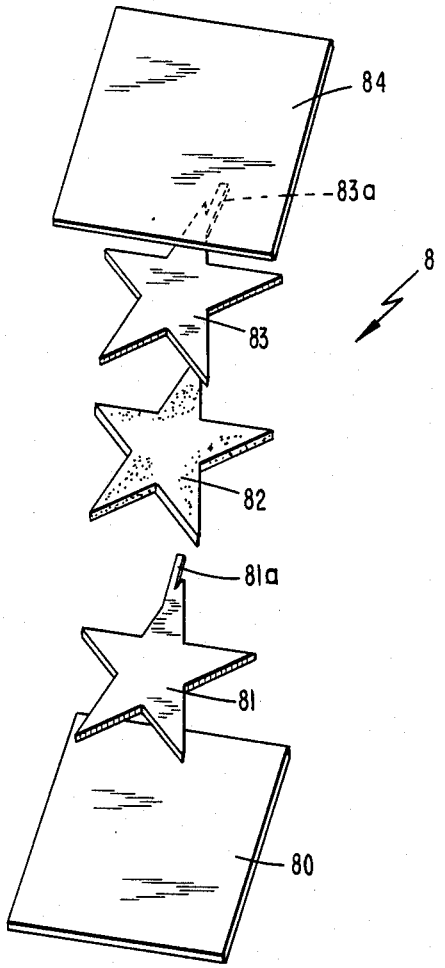
FIGS. 6 and 7 are an exploded perspective view and a sectional view, respectively, showing the constitution of a display element employed in the second embodiment.
Figure 7:
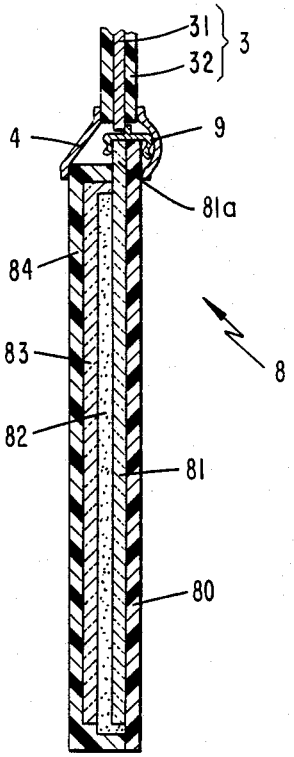

FIGS. 6 and 7 are explanatory views showing the constitution of the display element 8 employed in a second embodiment of the present invention. In FIGS. 6 and 7, there are shown a glass substrate 80, a first transparent electrode 81 including an electrode terminal 81*a* and formed by depositing a film of a transparent conductive substance, such as an ITO film, over the surface of the substrate 80 in a luminous shape, such as a star-shape, and an EL layer 82 formed over the surface of the first transparent electrode 81 in a shape corresponding to the luminous shape by applying a substance corresponding to the color of light to be emitted, such as ZnS doped with Cu which serves as the center of activation and Cl which serves as a flux. A second transparent electrode 83 including an electrode terminal 83*a* is formed by depositing a film of a transparent conductive substance, such as a film of ITO, over the surface of a transparent resin film, such as a polyester film, in a shape corresponding to the luminous shape and disposed over the EL layer 82 on the substrate 80 so that the electrode terminal 83*a* is offset to be out of alignment with the electrode terminal 81*a* of the first transparent electrode 81, and a protective member 84 formed by a transparent thin resin film consisting of superposed layers of an ethylene chloride trifluoride film and a polyester film, for sealing, together with the substrate 80, the first and second electrodes 81 and 83 and the EL layer 82.

A process of manufacturing the display element 8 will be described hereinafter.

First, the first transparent electrode 81 and the electrode terminal 81*a* of the same are formed in the luminous shape through evaporation or sputtering.

Secondly, the EL layer is formed over the first transparent electrode 81 in a shape corresponding to the luminous shape (ordinarily, the same shape as or a shape slightly larger than the shape of the first transparent electrode 81) through screen printing or the like.

Thirdly, a film of a transparent conductive substance, such as a film of ITO, is deposited over the surface of a transparent resin film, such as a flat polyester film, in the same or in the practically the same shape as the first transparent electrode 81, and then the area of the transparent resin film carrying the film of the transparent conductive substance is cut out to produce the second transparent electrode 83 with the electrode terminal 83*a*.

Fourthly, the second transparent electrode 83 is disposed on the EL layer 82 on the substrate 80 so that the electrode terminal 83*a* is offset out of alignment with the electrode terminal 81*a* of the first transparent electrode 81.

Fifthly, the protective member 84 coated over one side thereof with an adhesive is applied to the second transparent electrode 83, with the side coated with the adhesive in contact with the second transparent electrode 83, so as to leave the respective portions of the electrode terminals 81 and 83*a* of the first transparent electrode 81 and the second transparent electrode 83 respectively exposed.

Sixthly, the display element 8 is subjected to a laminating process at a suitable temperature and under a suitable pressure to seal the first and second transparent electrodes 81 and 83 and the EL layer 82 between the substrate 80 and the protective member 84.

The display element 8 thus produced is connected to the power supply lines 2 by means of the connecting cords 3 fixed to the electrode terminals 81*a* and 83*a*. The connecting cords 3 are connected satisfactorily to the electrode terminals 81*a* and 83*a* by soldering conductive pins 9 fixed previously to the electrode terminals 81*a* and 83*a* with a conductive paste, such as a silver paste, to the conductors 31 of the connecting cords 3 respectively, then welding one end of the connecting member 4 welded at the other end to the insulating covering 32 of the connecting cords 3 to the display element 8, and then fixing the connecting member 4 to the display element 8 further with a resin adhesive, such as an epoxy resin adhesive.

The display element, in the second embodiment, has the same light emitting function and effects as those of the first embodiment. Furthermore, forming the substrate 80 with a glass plate enables the direct deposition of the transparent conductive substance over the substrate 80 to form the first transparent electrode 81. Therefore, the transparent resin film employed in the first embodiment can be omitted. Consequently, the light emitted by the EL layer 82 is less attenuated, and hence the brightness of the display element is enhanced.

As has been described in detail hereinbefore, according to the present invention, the color of light and the shape of the display element can properly be selected, a two-sided luminous body of a wide luminous area can be provided, the decorative display apparatus is free from the dangers of heat generation and is capable of being operated by a power of a comparatively low voltage. Therefore, the decorative display apparatus of the present invention is capable of providing an excellent decorative display according to the articles to be decorated.

Furthermore, it would be obvious to those skilled in the art that the present invention may be embodied in several forms without departing from the spirit and scope of the present embodiments which are intended to be are illustrative and not restrictive. For example, a plurality of the display elements that shine in different colors and in different shapes from each other can readily be made by selectively deciding the particular substances for forming the EL layer and the shape of the EL layer specifically for each one of the display elements. As regards the exemplary substances for forming the EL layer, a substance containing ZnS as a matrix doped with Mn which serves as the luminous center emits orange light of a wide wavelength range with a peak approximately at 5850 Å and a substance containing the same matrix doped with Ag which serves as the luminous center emits blue light of a wide wavelength range with a peak approximately at 4550 Å.

Furthermore, in the embodiments described hereinbefore, the EL layer of the display element is formed in a thick layer through screen printing or the like, however, the EL layer may be of the thin film type formed in a thin film formed by evaporation or sputtering and coated over both sides with insulating layers in a three-layer structure. The EL layer of such a structure is capable of providing the same function and effects in emitting light.

What is claimed is:

1. A two-sided luminous display apparatus, comprising:

a plurality of two-sided flat luminous display elements each having an electroluminescent layer formed contiguously between opposite first and second transparent electrodes and capable of shining in predetermined color and shape when a voltage is applied to said transparent electrodes, wherein first and second electrode terminals respectively integral with said first and second transparent electrodes are formed for connection to power supply lines.

2. A two-sided luminous display apparatus according to claim 1, wherein each one of said display element comprises:

a transparent substrate;

said first transparent electrode is formed over said transparent substrate in a shape corresponding to a desired luminous shape and such that a part thereof extends to a peripheral part of said transparent substrate to form a first electrode terminal;

an electroluminescent layer formed by depositing over said first transparent electrode a substance corresponding to the required color of light;

a second transparent electrode formed over said electroluminescent layer in practically the same shape as that of said first transparent electrode and extended to a peripheral part of said transparent substrate to form a second electrode terminal which is offset to be out of alignment with said first electrode terminal of said first transparent electrode; and a transparent protective member covering said second transparent electrode.

3. A two-sided luminous display apparatus according to claim 2, wherein:

said transparent substrate and said protective member are each made of a transparent thin resin film.

4. A two-sided luminous display apparatus according to claim 3, wherein:

said transparent substrate and said protective member are subjected together to a laminating treatment at a suitable temperature and pressure, to seal therebetween said first transparent electrode, said electroluminescent layer and said second transparent electrode.

5. A two-sided luminous display apparatus according to claim 2, wherein:

said transparent substrate comprises a glass sheet, and said first transparent electrode is formed by directly depositing a transparent conductive substance over said glass sheet.

6. A two-sided luminous display apparatus according to claim 1, wherein:

said first and second electrode terminals of each display element are connected by a connecting cord to said power supply lines.

7. A two-sided luminous display apparatus according to claim 6, further comprising:

for each display element a connecting member individually and firmly attached at a first end to that display element and connected at a second end to the insulation of said connecting cord connected to said first and second electrode terminals of that display element.

8. A two-sided luminous display apparatus according to claim 7, further comprising:

on each of said connecting cords, at the end remote from said connecting member, a supply connector for connection thereby to said power supply.

* * * * *